United States Patent [19]

Karlsson et al.

[11] 3,934,276

[45] Jan. 27, 1976

[54] FLUSHING CISTERN

[75] Inventors: Frans Harry Karlsson, Lund; Per Torsten Faxen, Bromma, both of Sweden

[73] Assignee: Hykon-Patent Aktiebolag, Lund, Sweden

[22] Filed: May 21, 1973

[21] Appl. No.: 362,570

[30] Foreign Application Priority Data

May 26, 1972 Sweden ..... 6906/72

[52] U.S. Cl. ..... 4/41; 4/67 R; 4/249

[51] Int. Cl.[2] ..... E03D 1/36

[58] Field of Search ..... 4/58, 60, 1, 18, 33, 41, 4/52, 55, 56, 57 R, 65, 28, 67 R, 249

[56] References Cited

UNITED STATES PATENTS

| | | | |
|---|---|---|---|
| 755,166 | 3/1904 | Phillips | 4/55 |
| 768,688 | 8/1904 | Phillips | 4/55 |
| 2,879,521 | 3/1959 | Brasher | 4/56 |
| 2,882,533 | 4/1959 | Gray | 4/52 X |
| 3,619,821 | 11/1971 | Bobo | 4/55 X |
| 3,750,195 | 8/1973 | Roosa | 4/41 X |
| 3,810,261 | 5/1974 | Hollander | 4/41 |

FOREIGN PATENTS OR APPLICATIONS

| | | | |
|---|---|---|---|
| 113,731 | 10/1899 | Germany | 4/33 |
| 217,668 | 12/1967 | Sweden | 4/41 |
| 176,796 | 10/1961 | Sweden | 4/28 |

*Primary Examiner*—Richard E. Aegerter
*Assistant Examiner*—Stuart S. Levy
*Attorney, Agent, or Firm*—Browne, Beveridge, DeGrandi & Kline

[57] ABSTRACT

This invention provides an improved valve closing means for a refilling valve in flushing cisterns equipped with an overflow and refilling and flushing valves adapted to be opened by a lift stem, said valve closing means being mounted in said overflow and movable to an upper position for opening said valves by means of said lift stem and to a lower position for abrupt closure of the refilling valve by water flowing into the overflow when the cistern is refilled.

7 Claims, 4 Drawing Figures

FLUSHING CISTERN

Figure 1:
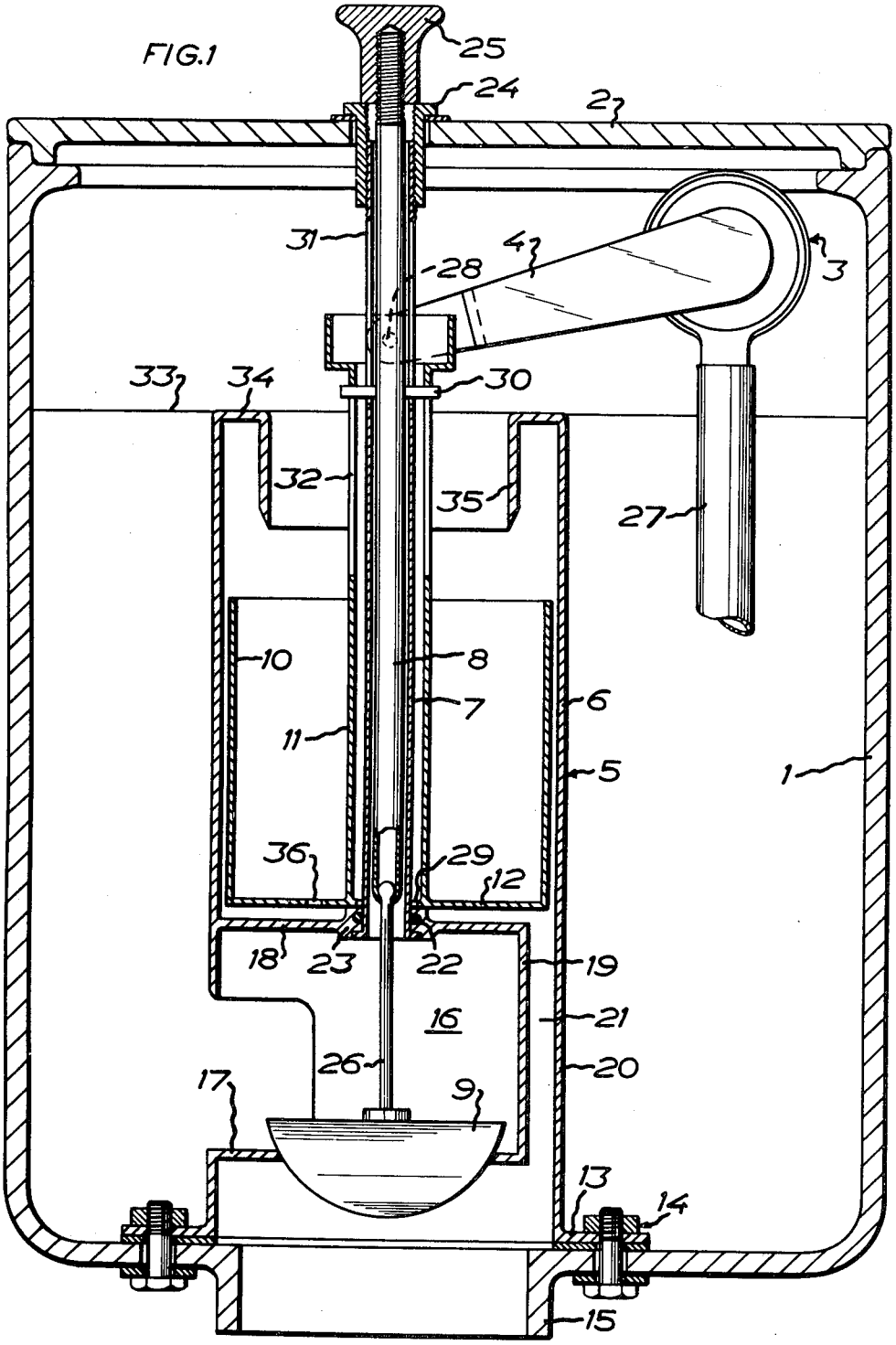

This invention relates to a flushing cistern, especially for water closets, comprising a container connected to a conduit for water under pressure via a refilling valve, an overflow, an outlet closable by means of a flushing valve, and a lift stem, adapted to open the flushing valve.

Conventional flushing cisterns for water closets generally comprise a refilling valve, a float having an operating arm, a bottom valve provided with a lift stem, and an overflow.

This type of flushing cisterns usually suffers from the drawback that a relatively long time is required for its refilling, and this drawback can be overcome only by means of special attachments. Besides, the float and its connection with the refilling valve in many cases is a sensitive device that rather often requires adjustment, repair or replacement.

It has already been suggested to use instead of flushing cisterns equipped with a float-operated valve flushing cisterns having a container connected to a conduit for water under pressure, in which container the amount of water collected for flushing purposes is under an air pressure determined by the pressure in the water conduit, a flushing pipe serving to connect the container to the water-closet pan via a valve which is opened by being relieved of a pressure acting upon the valve, for instance the flushing water pressure, the pressure from a load spring or both. In a known embodiment of such a flushing cistern the valve is mounted at the lower end of a through pipe disposed centrally in the container and connected to a piston which is freely movable in the pipe. Above the piston there is a pressure chamber which can be brought in communication by means of an auxiliary valve operated from outside with the atmospheric pressure in the flushing pipe, a chamber in the pipe below the piston being in direct communication with the interior of the container, while the pressure chamber above the piston is in direct communication via a conduit with the water pressure conduit leading to the container and is connected to the central pipe above the auxiliary valve via an adjustable needle valve. A flushing cistern of this kind, e.g., the flushing cistern disclosed in Swedish Pat. No. 176,796, certainly lacks both float and float-controlled refilling valve (the water supply is automatically stopped by a slow throttling operation when the pressure in the container approaches the same level as the water pressure) but requires a pressure-tight container and a relatively complicated mechanism having three valves.

In another known construction, use is likewise made of a pressure-tight flushing cistern in which the valve of the flushing pipe is operated manually against the action of a spring with the aid of a piston rod and a piston in a cylinder having ports connecting the chambers of the cylinder on both sides of the piston with the cistern. In this embodiment the piston has for its object to delay the closing of the flushing valve inasmuch as the spring to bring about the closing shall also displace the piston which, however, in order to be shifted must expell through restricted ports an amount of water corresponding to its stroke. In addition to the drain valve, this flushing cistern thus comprises a king of damping cylinder having a piston and a spring load and, as already mentioned, the cistern must be pressure-tight. Pressure-tight flushing cisterns of this type therefore have the feature in common that they require a complicated mechanism and they further have the common feature that the refilling is interrupted successively in step with the increase of the internal pressure in the cistern. With these devices it is not possible to realize a rapid shutt-off of the refilling water and a short refilling time.

The present invention has for its object to overcome the above-mentioned drawbacks and to provide a floatless flushing cistern which comprises a refilling valve and a relatively simple, reliable operating mechanism for automatic, safe and rapid (abrupt) closure of the refilling valve. By reason of the particular design of this flushing cistern the overflow can be utilized to operate a valve closing means.

According to the invention the refilling valve is connected to the lift stem to be opened by said lift stem when the latter is actuated for flushing of the water-closet pan, and to a valve closing means mounted in said overflow and movable between an upper and a lower position, said valve closing means being brought to the upper position upon actuation of the lift stem and returned to the lower position for closing the refilling valve by being hit by or filled with water which, when the container is full, flows into the overflow.

As will appear from the following description and the claims appended thereto, those functions of the preferred embodiment of the flushing cistern according to the invention, which in conventional flushing cisterns having refilling valves are performed by the float, the flushing valve with lift stem and overflow, have been integrated into a single easily installable unit. This will reduce the time for mounting the requisite equipment at the flushing cistern and the risk of errors of mounting and adjusting it. Moreover, the integration of said functions into a single unit is space-saving and gives the interior of the cistern a simple, functional and consequently attractive appearance.

Figure 2:
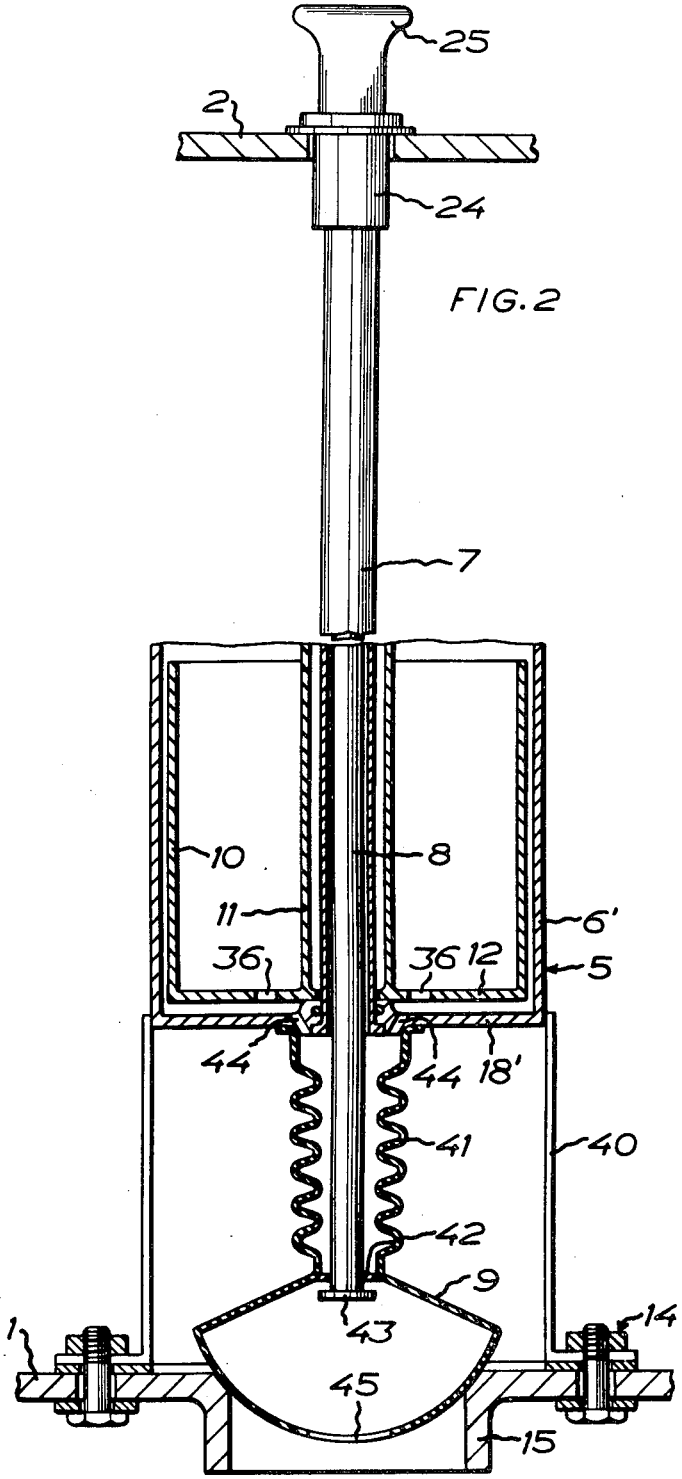
Figure 3:
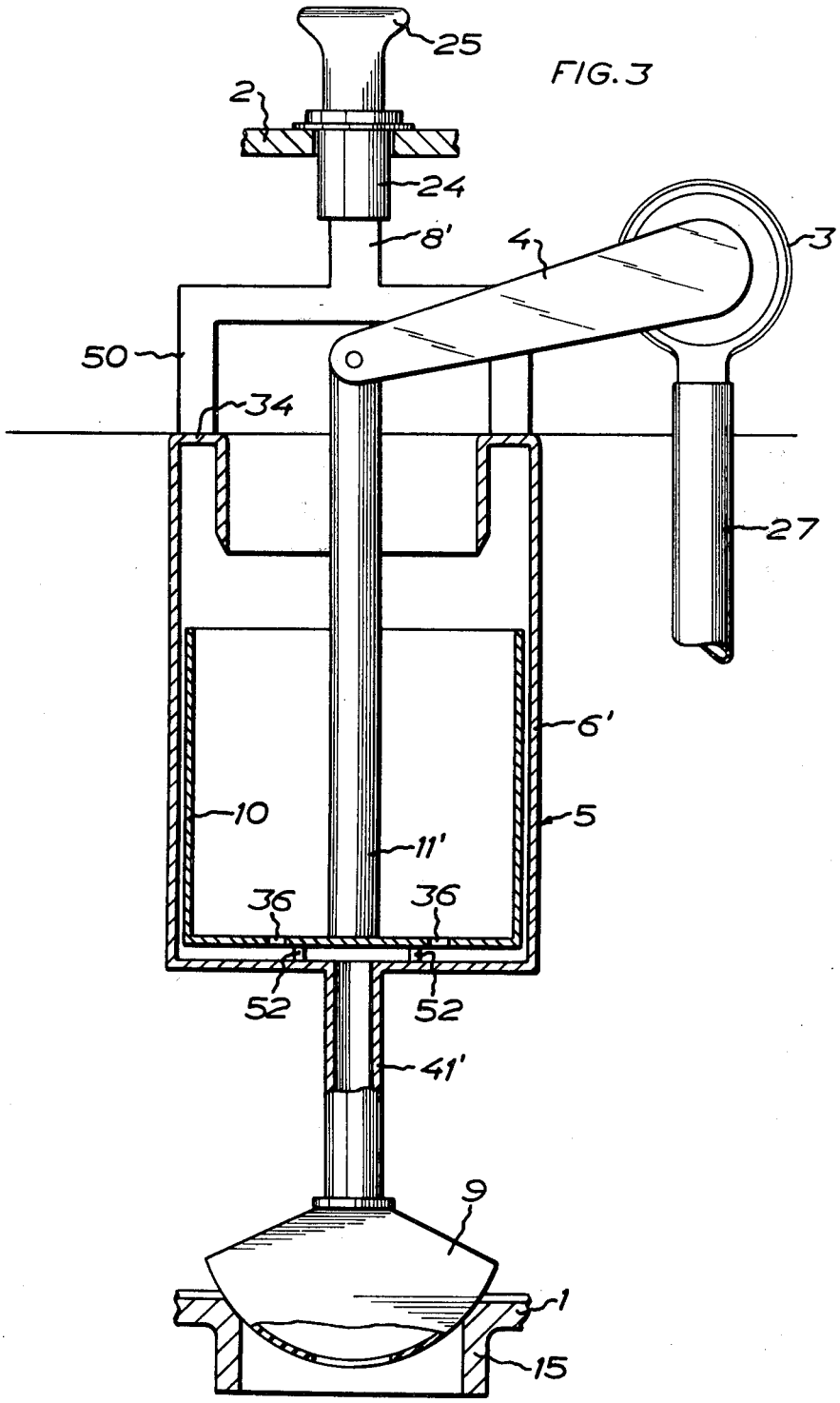
Figure 4:
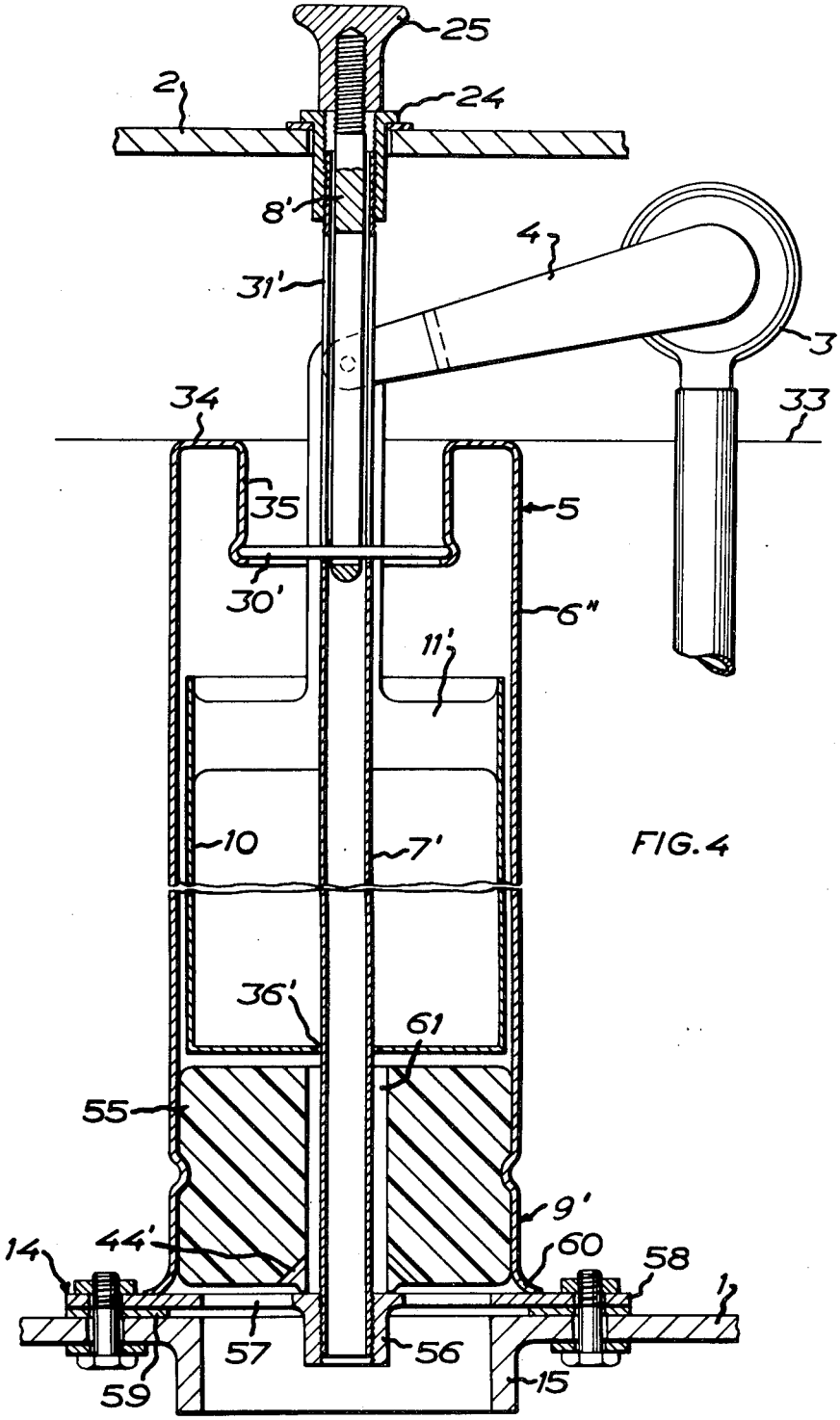

The invention will be more fully described hereinbelow with reference to the accompanying drawings in which:

FIG. 1 in vertical section shows an embodiment of a flushing cistern with flushing mechanism and refilling mechanism;

FIGS. 2 and 3 in fragmentary vertical sections show two modified embodiments of the flushing cistern;

FIG. 4 shows a further modification of the flushing valve and the refilling valve closing mechanism.

In the embodiment illustrated in FIG. 1, the flushing cistern consists of an essentially conventional container 1 having a cover 2, a refilling valve 3 with an operating arm 4, and a unit generally designated 5, which is mounted centrally in the container 1 and comprises a discharge vessel having a lift stem tube 7 fixed centrally in said vessel, a valve lift stem 8 mounted in said tube 7, a drain valve 9 (flushing valve) connected to the lift stem 8, and a movable cup 10 disposed in the vessel 6 and coupled with the lift stem 8 and the operating arm 4 of the refilling valve in a manner described in more detail hereinbelow by means of a central tubular yoke 11 attached to the bottom 12 of the cup 10.

In the embodiment illustrated in FIG. 1, the vessel 6, which forms a support for the unit 5, consists of an integral piece, preferably of plastics, in the form of an upright cylinder which is open at the top and at the bottom has an annular end flange 13 which by means of bolted unions 14 is fastened around the periphery of an outlet socket 15 in the bottom of said cistern for connection with a water-closet pan. In the lower end portion the wall of the vessel 6 is recessed so that an inwardly closed and outwardly open chamber 16 is formed. At the bottom the chamber 16 is defined by a horizontal bottom wall 17 forming a valve seat with hole thesein for the flushing valve 9. The roof 18 of the chamber is horizontal as is the valve seat 12, while the side wall 19 of the chamber like the confronting vessel wall portion 20 is vertical and together with said vessel wall portion defines a vertical channel 21 connecting the main portion of the vessel 6 with the socket 15.

The lower flanged end of the lift stem tube 7 is fitted in a water-proof manner in a hole in the roof 18 of the chamber 16 and is sealed by means of a sealing ring 22 with respect to the boundary wall of said hole which is formed by an annular rim 23. The sealing fit of the lift stem tube 7 in the annular rim 23 is such that the pipe can be swung to some extent in relation to the roof 18 to compensate for centre line deviation of the hole in the wall 18 to a corresponding hole in the cover 2, which accomodates an ordinary pipe nut 24 screwed fast to the upper threaded end portion of the lift stem tube 7.

The lift stem 8, which is axially movably mounted in the lift stem tube 7, has a handle in the form of a knob 25 attached to the upper end projecting from the pipe nut 24. The stem 8 is tubular at least in its lower portion and receives in its lower end a pull rod 26 which is connected to the flushing valve 9 and has a ball-shaped upper end which is retained in the lift stem 8 in that the tubular lower end thereof is bent inwardly to form an annular flange. The lift stem 8 is slidable relative to the pull rod 26, the ball-shaped upper end of which cannot be withdrawn from the lower end of the lift stem having the inwardly bent annular flange. Thus, the lift stem 8, the pull rod 26 and the flushing valve 9 can be pulled upwardly for flushing by means of the handle 25, and upon subsequent release of the handle 25 the lift stem 8 will slide downwardly in the tube 7 and with respect to the pull rod 26. The flushing valve 9, which may consist of a hollow hemispherical ball of rubber or plastics and which during flushing floats on the water, automatically returns to the position shown in FIG. 1 when flushing is completed.

The refilling valve 3, which may be of the type described in Swedish Pat. No. 217,668, is connected to an inlet pipe 27 opening close to the bottom of the container. The operating arm 4 of the valve 3 is connected by means of a pivot 28 to the tubular yoke 11 which coaxially surrounds the lift stem tube 7 and is connected to the bottom wall 12 of the cylindrical cup 10 which is coaxially enclosed by and spaced some distance from the cylindrical wall of the vessel 6. In the position of readiness shown in FIG. 1 the bottom wall 12 of the cup 10 rests on the upper surface of the annular rim 23 at some distance from the roof 18 of the chamber 16 and is guided on the lift stem tube 7 by means of an annular flange 29 inwardly of the yoke 11. At its upper end the lift stem 8 carries a pin 30 the opposite end portions of which extend through two axial, diametrically positioned slots 31 in the lift stem tube 7 and through two corresponding slots 32 in the tubular yoke 11. In the position of readiness of the valve operating mechanism shown in FIG. 1 the slots 31 extend upwardly and the slots 32 downwardly from the pin 30.

The function of the mechanism described above is as follows.

In the position of readiness shown in FIG. 1 the flushing cistern is filled with water up to the level 33. The operating arm 4 is in its lowermost position and the refilling valve 3 is closed. The cup 10 with its yoke 11 is also in its lowermost position as are the lift stem 8 and the flushing valve 9. Thus said valve 9 is closed and prevents the water in the cistern from flowing from the open side of the chamber 16 down into the outlet socket 15.

For flushing, the lift stem 8 is pulled upwardly by means of the handle 25. This pull will unseat the flushing valve 9 by the intermediary of the pull rod 26 in the manner usual in flushing water cisterns. Now, the water in the cistern starts to escape through the seat 17 of the flushing valve and flows via the socket 15 into the water-closet pan. At the upward pull of the lift stem 8 the pin 30 is also lifted carrying the yoke 11 and the cup 10 along in its movement, whereby the operating arm 4 is swung upwardly and opens the refilling valve 3 which starts to fill the cistern through the inlet pipe 27. In spite of this the cistern is rapidly emptied through the outlet socket 15.

When, as must be assumed, the handle 25 is released after the upward pull thereof the lift stem 8 falls down into the position of readiness shown in FIG. 1, while the flushing valve 9 only after completed flushing returns to the position of readiness in the manner already described and closes the outlet. However, the cup 10 with the yoke 11 and the operating arm 4 remain in the upper position because the total weight thereof, which is comparatively small, cannot overcome the resistance originating from the friction in the movable system and particularly the friction of the movable valve member of the refilling valve.

When the flushing valve 9 is closed but the refilling valve 3 is open the water level in the cistern rises and after a few minutes reaches the upper edge 34 of the vessel 6. The water then starts to flow over the edge and is guided into the cup 10 by the collar-shaped wall portion 35 depending from the inwardly directed edge 34 of the vessel 6. The weight and speed of the water causes the cup 10 rapidly to sink to its bottom position, the yoke 11 connected with the cup swinging the operating arm 4 downwardly, whereby the refilling valve 3 is closed and the supply of water to the cistern is stopped. The cup 10 is emptied through a bottom hole 36 in the cup, the interspace between the bottom of the cup and the roof 18 of the chamber 16, the gap 21 between the vertical vessel walls 19, 20 at the chamber-forming recess and through the socket 15. The water in the vessel 6 flows between the vessel and the cup 10 through the gap 21 and into the socket 15. Thus, the vessel 6 and the cup 10 form an overflow, the upper edge 34 of the vessel 6 determining the maximum water level 33.

The dimensions of the vessel 6 and the cup 10 as well as those of the bottom hole 36 of the cup and the interspace for letting the water from the vessel and the cup escape past the flushing valve 9 may, by simple calculation, easily be adapted to the forces required for closing the refilling valve 3 and for ensuring that no flooding arises if the refilling valve 3 for some reason should jam in its open position.

It will be realized from the foregoing that as compared with a conventional flushing cistern having a refilling valve, a float with an arm, a bottom valve with a lift stem, and an overflow, the preferred embodiment of the flushing cistern according to the invention dispenses with the float and a separate overflow and comprises merely two units, viz. the refilling valve 3 with the operating arm 4 and the unit generally designated 5 which combines in itself the functions of bottom valve with lift stem, operating mechanism for the refilling valve, and overflow. The unit 5 may be assembled and adjusted outside the cistern and then easily be mounted in position therein and connected to the operating arm 4 of the refilling valve 3 without necessitating any supplementary adjustments. Another essential advantage is the rapid, firm closing of the refilling valve 3 that is realized when the cup 10 is caused to move downwardly by the water flowing into it.

The modification shown in FIG. 2 differs from the embodiment in FIG. 1 in some respects. Thus, the flushing valve 9 is adapted to close the bottom hole in the cistern 1 at the mouth of the socket 15. The vessel 6' may be of the same configuration as the upper portion of the vessel 6 in FIG. 1, but the wall 18 in FIG. 1 here forms a wall 18' closing the vessel 6' at the bottom thereof. The vessel 6' is supported at a distance from the bottom of the cistern 1 by means of a holder 40, which is connected to the bottom of the cistern by bolted unions 14. The holder 40 may consist of vertical rods or any suitable device whatever that is capable of letting through water. The flushing valve 9 is connected to the bottom wall 18' of the vessel 6' by means of tubular bellows 41 and can be pulled upwardly, under folding of the bellows 41, by means of the lift stem 8 which extends into the flushing valve 9 and is adapted to engage a ring 42 in an upper opening of the hollow flushing valve 9 and an end flange 43 on the stem 8. The cup 10 is of the same configuration as in FIG. 1 and is in communication with the socket 15 through one or more bottom holes 36 in the cup, one or more holes 44 in the bottom wall 18' of the vessel 6', the cavity in the bellows 41, the hole in the ring 42 and a hole 45 in the lower wall of the hollow flushing valve 9.

The operating mechanism for the modification in FIG. 2 is of the same function as the operating mechanism for the embodiment in FIG. 1, but the recessed portion (shown in FIG. 1) of the vessel 6 for forming the chamber 16 and the valve seat 17 is eliminated. The essential difference resides in that the communication for empyting the vessel 6' and the cup 10 extends through the actual flushing valve 9 and not beside it.

In the embodiment illustrated in FIG. 3 the vessel 6', which is of the same configuration as the vessel 6' in FIG. 2, is suspended by means of a yoke 50 in the lift stem 8' which thus has another construction and function than in FIGS. 1 and 2. The flushing valve 9 is fixedly connected with the bottom wall of the vessel 6' by a pipe 41' and is in communication with the vessel 6' and the socket 15 through the actual flushing valve 9 like in FIG. 2. The central yoke 11' of the cup 10 consists of a rod pivoted to the operating arm 4 of the refilling valve 3. By means of the handle 25 the vessel 6' and the valve 9 as well as the cup 10 with the yoke 11' and the operating arm 4 are lifted simultaneously. When the handle 25 is released the vessel 6' and the valve 9 return to their lower positions shown in FIG. 3 as soon as flushing has been completed. However, the cup 10 remains in its upper position because of the frictional forces acting on the arm 4 and returns to its lower position when water from the cistern flows over the edge 34 into the cup 10. The cup 10 is emptied through the bottom holes 36.

The embodiment shown in FIG. 4 differs from those in FIGS. 2 and 3 int. al. by another configuration of the flushing valve. In the FIG. 4 embodiment the outlet vessel 6'' is integral with the flushing valve 9'. The outlet vessel 6'' is in the form of an upright cylinder and has a lower extension accommodating an annular floating body 55 surrounding the lift stem tube 7' which is extended downwardly and has its lower threaded end portion screwed into a sleeve 56. A plurality of arms 57 connect said sleeve 56 with a ring 58 which in turn is sealingly connected to the bottom of the flushing cistern 1 around the outlet 15 by means of a gasket 59 and bolted unions 14 corresponding to the unions 14 in FIG. 1. The ring 58 forms a seat for the flushing valve 9' the lower end of which is formed by an outwardly flared portion 60 of the extension of the vessel wall 6''. The floating body 55 surrounds the lift stem tube 7' but leaves a clearance to said tube in order to define a gap 61 sufficient to empty the vessel 6'' through said gap and through one or more holes 44' into the outlet 15. The cup 10 has one or more bottom holes 36' for emptying the cup the same way. In this embodiment the cup 10 is connected to the operating arm 4 by means of a yoke 11' integral with the cup and extending upwardly from the upper edge portion of the cup. Here, connection between the lift stem 8' and the flushing valve 9' is established by means of a pin 30' secured in the collar-shaped wall portion 35 which extends downwardly in the vessel 6'' from the upper edge 34 thereof to conduct overflowing water into the cup 10. The pin 30' is movable, in the manner described with reference to FIG. 1, in a slot 31' in the lift stem 8' within the limits determined by the slot ends. When the lift stem 8' is lifted by means of the handle 25 the entire unit 5 comprising the vessel 6'' serving as flushing valve and the cup 10, is thus raised, the operating arm 4 being simultaneously swung upwardly, whereby the refilling valve 3 is opened. When flushing has been effected (and provided that the handle 25 is released after flushing has been initiated) the vessel 6'' floating in the water and the portion thereof serving as flushing valve 9' return to the closed position shown in FIG. 4, as soon as the sinking water in the flushing cistern permits it. The cup 10, however, remains in the upper position (for the reason explained in connection with the description of the embodiment in FIG. 1) until the water in the flushing cistern has reached the edge 34 of the vessel 6'' (the water level 33 in FIG. 4), when the cup is returned to the lower position under the weight of the water flowing into it, thereby closing the valve 3.

The valve closing means (vessel 6, 6', 6'' and the cup 10) may be placed laterally of the flushing valve 9 and the socket 15. In this case a linkage is required to transmit the movements of the lift stem 8 to the cup 10. However, such a linkage suffers from the drawback that it requires a more complicated movement transmitting mechanism. The advantage is that the flushing valve 9 becomes more readily accessible.

Instead of making the cup 10 and the vessel 6, 6', 6'' entirely of plastics, which is a very suitable material for the construction according to the invention, these details may of course be made of metal. The invention is not either restricted to the embodiments described in the foregoing, but many modifications, with respect to the details and the location thereof, may be resorted to within the scope of the appended claims.

What we claim and desire to secure by Letters Patent is:

1. A flushing cistern for water closets having a container with a bottom discharge opening, comprising a refilling valve for admitting water into the container, an opening having an outlet valve seat connecting a lower part of the container to the discharge opening, a flushing valve for closing said valve seat, an overflow member providing an overflow passage connecting the discharge opening and an upper portion within the container for limiting the water level in the container to the elevation of said upper portion, said overflow member being an upright tubular member open at its upper end and comprising a lower end portion connected to and tightly surrounding said discharge opening in the bottom of the container, said tubular member having a cylindrical portion and a constricted portion located between said cylindrical portion and said lower end portion, said constricted portion being formed by wall means forming a chamber which constricts the overflow passage in said constricted portion, an opening connecting the chamber to the interior of the container, said wall means comprising chamber top wall and bottom wall members, the bottom wall member having an opening forming said flushing valve seat, a manually operable actuating means for unseating said flushing valve and opening said refilling valve to start a flushing and refilling cycle, a refilling valve closing means mounted in said overflow passage and being movable therein between an upper and a lower position, said valve closing means being coupled to said actuating means and movable thereby to the upper position upon starting of said cycle, said valve closing means being coupled to the refilling valve to close the refilling valve by movement to its lower position, said valve closing means comprising a cup movably positioned in the cylindrical portion of said tubular member above said chamber top wall member to receive water flowing into the overflow member, said cup having a bottom hole which forms at least a part of said overflow passage and through which the cup is emptied to said discharge opening, said valve closing means being positioned and constructed to receive and be weighted by water flowing into the overflow member to move the valve closing means to its lower position thereby closing the refilling valve; said flushing valve, overflow member and cup form an assembly removably mounted on the bottom of said container.

2. A flushing cistern as claimed in claim 1, wherein said overflow member, said outlet valve seat and said flushing valve are arranged as a unit detachably mounted on the bottom of said flushing cistern.

3. A flushing cistern as claimed in claim 1 wherein a lift stem guiding tube is mounted in the container, said tube having an upper end mounted in an opening in a container top wall and a lower end tightly fastened in an opening in said chamber top wall member, said actuating means including a lift stem slidably mounted in said guiding tube and extending with an end portion projecting outside the container, said cup having a tubular central lifting yoke which coaxially surrounds the lift stem tube, an operating arm which is connected at one end to the refilling valve and at the other end to the lifting yoke, coupling means comprising a pin affixed to the lift stem and movably engaging at least one axial slot formed in the wall of said tubular yoke and a corresponding axial slot formed in the lift stem guiding tube, said pin and the slots being dimensioned to permit the cup to be raised to its upper position by means of the lift stem as the coupling pin engages an upper boundary surface of the slot of the yoke, during which movement the coupling pin is movable in the slot of the lift stem guiding tube, said slots being positioned and dimensioned to permit separate downward movement of the lift stem upon release of said stem, while the cup is allowed to remain in its upper position until it receives and is weighted by water from the upper end of said tubular overflow member.

4. A flushing cistern as claimed in claim 3, having guide means connected to the yoke and the cup for guiding the lower end of the lifting yoke relative to the lift stem guiding tube, said pin on the lift stem guiding tube being in guiding engagement within the slots on the lifting yoke to guide the upper end of the yoke.

5. A flushing cistern as claimed in claim 4, wherein said flushing valve, the lift stem, the lift stem guiding tube and the cup with the lifting yoke, are all arranged as a unit which is detachably connected to the following elements: the bottom of the container, the operating arm of the refilling valve by said pivot connection, a screw connection connecting the lift stem tube to the container top wall.

6. A flushing cistern for water closets having a container with a bottom discharge opening, comprising a refilling valve for admitting water into the container, an opening having an outlet valve seat connecting a lower part of the container to the discharge opening, a flushing valve for closing said valve seat, an overflow member providing an overflow passage connecting the discharge opening and an upper portion within the container for limiting the water level in the container to the elevational of said upper portion, said overflow member comprising an upwardly open cylindrical vessel having a central bottom opening, a manually operable actuating means for unseating said flushing valve and opening said refilling valve to start a flushing and refilling cycle, said actuating means including a lift stem extending centrally through said central bottom opening of said vessel and being connected at its lower end to said flushing valve member, said flushing valve member having a hollow body at a distance above the container discharge opening, a refilling valve closing means mounted in said overflow passage and being movable therein between an upper and a lower position, said valve closing means being coupled to said actuating means and movable thereby to the upper position upon starting of said cycle, said valve closing means being coupled to the refilling valve to close the refilling valve by movement to its lower position, said valve closing means being positioned and constructed to receive and be weighted by water flowing into the overflow member to move the valve closing means to its lower position thereby closing the refilling valve; a bellows tightly connecting the body of the flushing valve to the bottom of said vessel, a guide tube means guiding the lift stem in said vessel, said guide tube having a lower end tightly fastened in said opening in the bottom of the vessel; the lift stem extending through the bellows and having means at its lower end for lifting engagement with the flushing valve; said vessel being formed with holes communicating with the bellows; said hollow flushing valve member having an upper opening in communication with the bellows and a bottom opening in communication with said discharge opening to communicate the bellows with the container discharge opening.

7. A flushing cistern for water closets having a container with a bottom discharge opening, comprising a refilling valve for admitting water into the container, an outlet valve seat forming an opening which leads from a lower part of the container to the discharge opening, a flushing valve for closing said valve seat, an overflow member providing an overflow passage connecting the discharge opening and an upper portion within the container for limiting the water level in the container to the elevation of said upper portion, a manually operable actuating means for unseating said flushing valve and opening said refilling valve to start a flushing and refilling cycle, said overflow member being an upwardly open cylindrical vessel which also serves as a portion of said actuating means, a tube supporting the flushing member and forming an open communication leading from the vessel to the container discharge opening through the flushing valve member, said vessel having its bottom connected to said tube; a refilling valve closing means mounted in said overflow passage and being movable therein between an upper and a lower position, said valve closing means being coupled to said actuating means and movable thereby to the upper position upon starting of said cycle, said refilling valve closing means being coupled to the refilling valve to close the refilling valve by movement to its lower position, said valve closing means being positioned and constructed to receive and be weighted by water flowing into the overflow member to move the valve closing means to its lower position thereby closing the refilling valve, said refilling valve closing means including a cup movable between said upper and lower positions in said vessel, a coupling member on the cup, an operating arm for the refilling valve coupled to the coupling member, said vessel being movable upwardly to raise the cup to open the refilling valve whereby after flushing the vessel returns to the position corresponding to a closed flushing valve in order to function as said overflow member to conduct overflowing water into the cup.

* * * * *